United States Patent [19]

Hellwig et al.

[11] 4,396,860

[45] Aug. 2, 1983

[54] ELECTRIC LAMP WITH A SLEEVE-SHAPED CAP

[75] Inventors: Paul Hellwig; Werner Schlagheck, both of Aachen, Fed. Rep. of Germany

[73] Assignee: U.S. Philips Corporation, New York, N.Y.

[21] Appl. No.: 175,630

[22] Filed: Aug. 6, 1980

[30] Foreign Application Priority Data

Aug. 11, 1979 [DE] Fed. Rep. of Germany ..... 2932638

[51] Int. Cl.[3] ..... H01J 5/48; H01J 5/50

[52] U.S. Cl. ..... 313/318; 313/315; 339/144 R; 339/145 R

[58] Field of Search ..... 313/318, 315; 339/144 R, 145 R

[56] References Cited

U.S. PATENT DOCUMENTS

| | | | |
|---|---|---|---|
| 2,692,154 | 10/1954 | Wigan | 339/144 R |
| 3,173,735 | 3/1965 | Fenn | 339/144 R |
| 3,262,001 | 7/1966 | Rijckeart | 313/318 X |
| 4,013,335 | 3/1977 | Jarkonyi et al. | 339/144 R |
| 4,119,877 | 10/1978 | Grewe et al. | 339/145 R |
| 4,122,367 | 10/1978 | Esklavon et al. | 313/318 |
| 4,295,076 | 10/1981 | Eckhardt et al. | 313/318 |

*Primary Examiner*—Saxfield Chatmon, Jr.
*Attorney, Agent, or Firm*—Robert S. Smith

[57] ABSTRACT

In an electric lamp with a sleeve-shaped cap and an inner sleeve carrying the bulb, the cap has at least two lugs protruding inwards and the inner sleeve is provided with at least two slots on its cylindrical sheath, which engage the lugs.

6 Claims, 11 Drawing Figures

ELECTRIC LAMP WITH A SLEEVE-SHAPED CAP

The invention relates to an electric lamp with a bulb and a sleeve-shaped cap, in which a cylindrical inner sleeve carrying the bulb is inserted.

In the case of normal lamps of this kind (e.g. DE-OS No. 1 489 414 or FR-PS No. 769 029) the cap and the inner sleeve are joined together by soldering or welding after assembly. Connections of this kind are troublesome and expensive. There is also the problem that the material can be destroyed during spot welding if thin material pieces are used.

The invention is therefore based on the problem of creating an electric lamp whose cap and inner sleeve can be connected with no additional heat treatment, such as welding or soldering.

In the case of an electric lamp of the aforementioned type, this problem is solved, according to the invention, by the sleeve shaped cap having at least two lugs protruding inwards and the inner sleeve being provided on its cylindrical sheath with at least two slots extending in the direction of the lamp axis, which slots open into the end of the inner sleeve remote from the bulb and engage the lugs.

In this way a purely mechanical fastening is achieved between lamp cap and inner sleeve.

In one embodiment, the lugs are formed in the shape of protrusions pushed inwards from the metal wall of the cap. Of course, the lugs can alternatively be formed in the shape of pins attached to the cap and protruding inwards.

Due to the combined effect of the inner sleeve's slots and the cap lugs, the cap and inner sleeve are guaranteed not to twist relative to each other. Movement in the direction of the axis is prevented if the power supply leads protruding from the bulb are tightened and soldered to the cap contacts.

The slots may be shaped so that they widen to the edge. The cap and inner sleeve can then be put together easily, without the two parts having to be precisely adjusted to one another beforehand.

If, for mechanical reasons for instance, the power supply leads are not suitable as a means of preventing axial movement between the cap and the inner sleeve, then in an advantageous version of the lamp according to the invention the slot can be provided with spring clips which are pressed apart by the cap lugs during insertion of the inner sleeve into the cap, and in the final position of the inner sleeve spring back behind the lugs. In this way the spring clips of the inner sleeve actually snap in behind the cap lugs, thus ensuring that the inner sleeve is firmly secured in the cap, even in the direction of the axis.

The clips may consist of inwardly-bent spring-loaded edges of the inner sleeve's cylindrical sheath adjacent the slots.

The lamps according to the invention may be incandescent lamps used in motor vehicles, for example as tail lights or as flasher lamps.

Two embodiments of lamps according to the invention are now described in more detail on the basis of the diagram;

Figure 1:
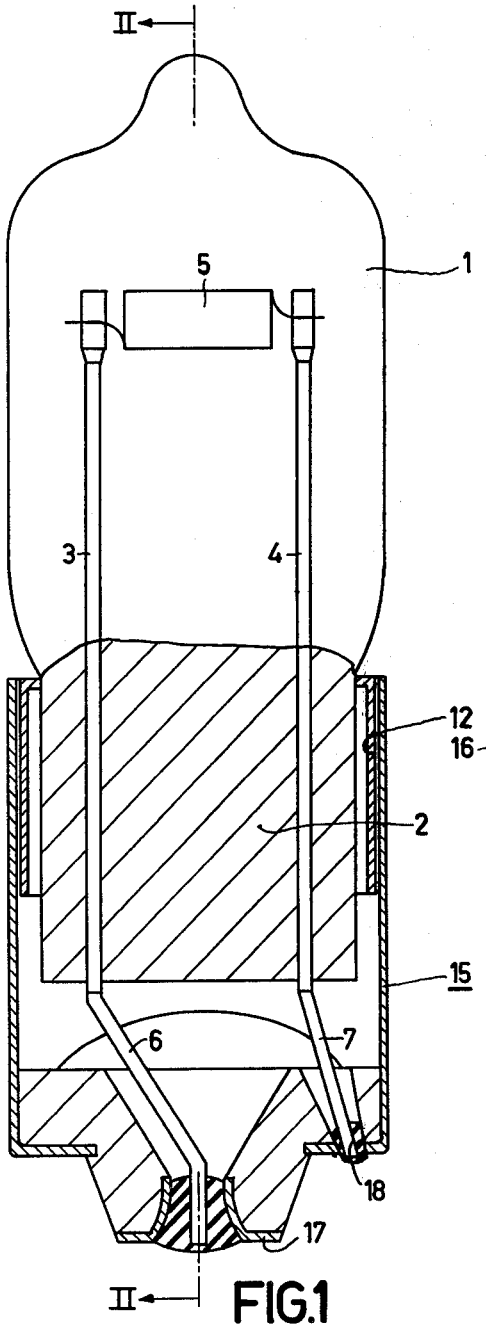
FIG. 1 shows a longitudinal section through an incandescent lamp, the bulb of which is secured to an inner sleeve, which in turn is housed in a cap.
Figure 2:
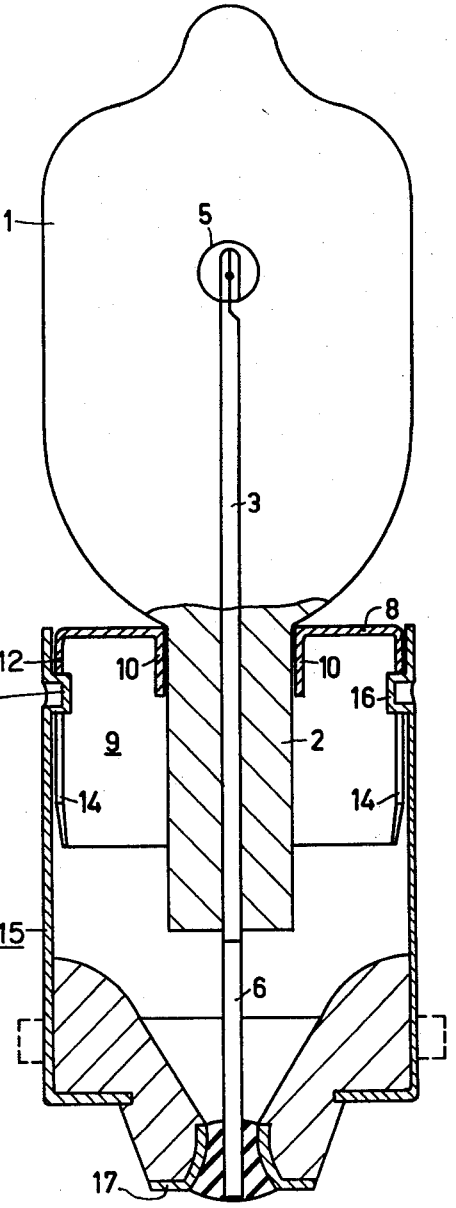
FIG. 2 shows a longitudinal section through the lamp as in FIG. 1, along the line II—II.

In FIGS. 1 and 2, 1 is a bulb, made for instance of hard glass, in a small halogen incandescent lamp, which at its end has a pinch 2 which is rectangular in cross-section and in which power leads 3 and 4, leading to a coil 5, are embedded, the ends 6 and 7 of which protrude from the pinch 2.

Figure 4:
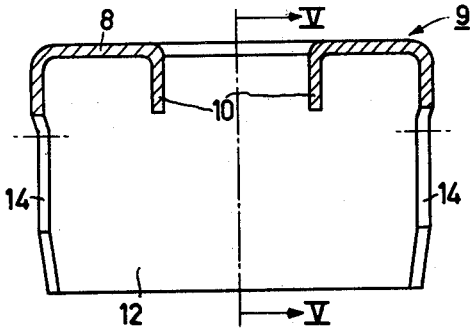
FIG. 4 shows a longitudinal section through the inner sleeve as in FIG. 3, along the line IV—IV.
Figure 5:
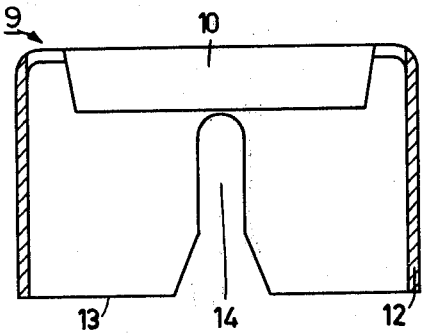
FIG. 5 shows a longitudinal section, turned through 90°, through the inner sleeve along the line V—V in FIG. 4.
Figure 3:
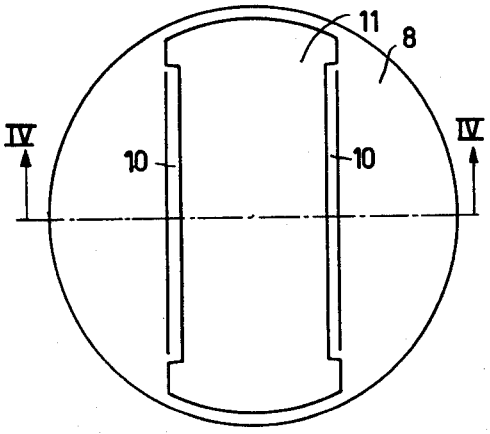
FIG. 3 shows a top view onto the inner sleeve of the lamp as in FIGS. 1 and 2, on a larger scale.
Figure 6:
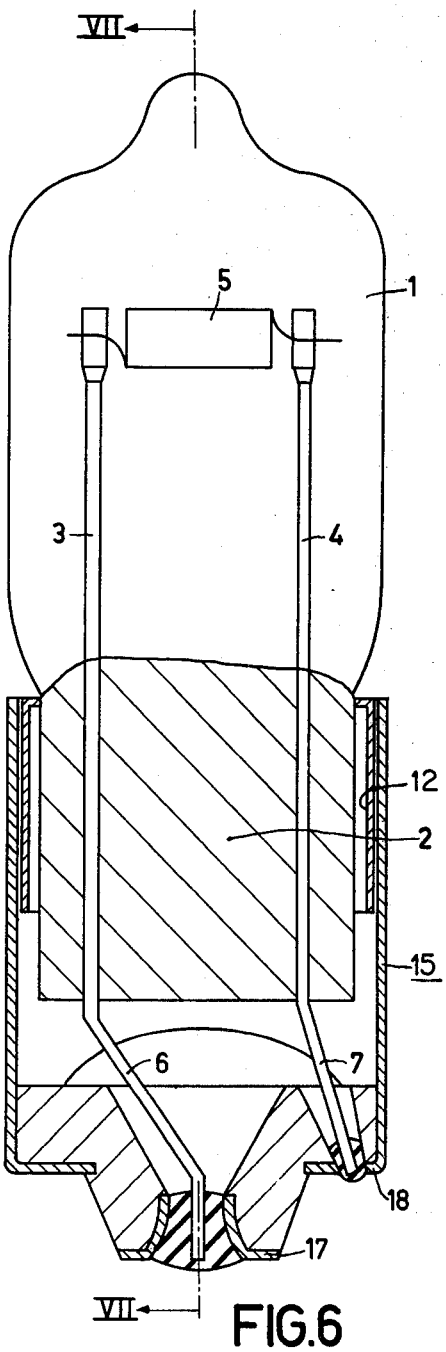
FIGS. 6 and 7 show two longitudinal sections, turned through 90°, of an incandescent lamp with a different kind of inner sleeve.

The lamp bulb 1, together with its pinch 2, is fixed in a coverplate 8 of a metal inner sleeve 9 (FIGS. 3 to 5). For this purpose, two holding clips 10 are pressed out of the coverplate 8 at right angles, the distance between them corresponding to the thickness of the pinch 2. The pinch 2 is jammed into the opening 11 thus created in the coverplate 8, until it comes up against the bulb 1.

The inner sleeve 9 is provided on its cylindrical sheath 12 with two slots 14 extending in the direction of the lamp axis as far as the edge 13 remote from bulb 1 and opening into the edge 13.

The inner sleeve 9 is placed tightly in a metal sleeve-shaped cap 15. For this purpose, the cap 15 has two lugs 16 protruding inwards, over which the slots 14 of the inner sleeve 9 fit, when the latter is inserted into the cap 15. By this means the cap 15 and the inner sleeve 9 are guaranteed against twisting relative to one another. The inner sleeve 9 is pushed into the cap 15 until the cap lugs 16 come up against the end of the slots 14 in the cylindrical sheath 12 of the inner sleeve 9. The ends 6 and 7 of the power leads 3 and 4 are then soldered to the cap contacts 17 and 18 after being tightened, so that the inner sleeve 9 in the cap 15 is also secured in the direction of the axis.

FIGS. 6 to 11 show another embodiment of the lamp according to the invention, in which the axial securing of the inner sleeve in the lamp cap is done differently The same parts have been given the same references as in FIGS. 1 to 5. In this embodiment, however, the holding clips 10 in the coverplate 8 of the inner sleeve 9 are not at right angles, but are simply bent inwards at an angle. On its two major surfaces, the pinch 2 of the lamp bulb 1 has shoulders 19, running at right angles to the lamp's longitudinal axis, behind which the holding clips 10 of the inner sleeve 9, bent at an angle, lock into position when the lamp bulb 1 is inserted. This type of plate is known from U.S. Pat. No. 4,119,877.

Figure 7:
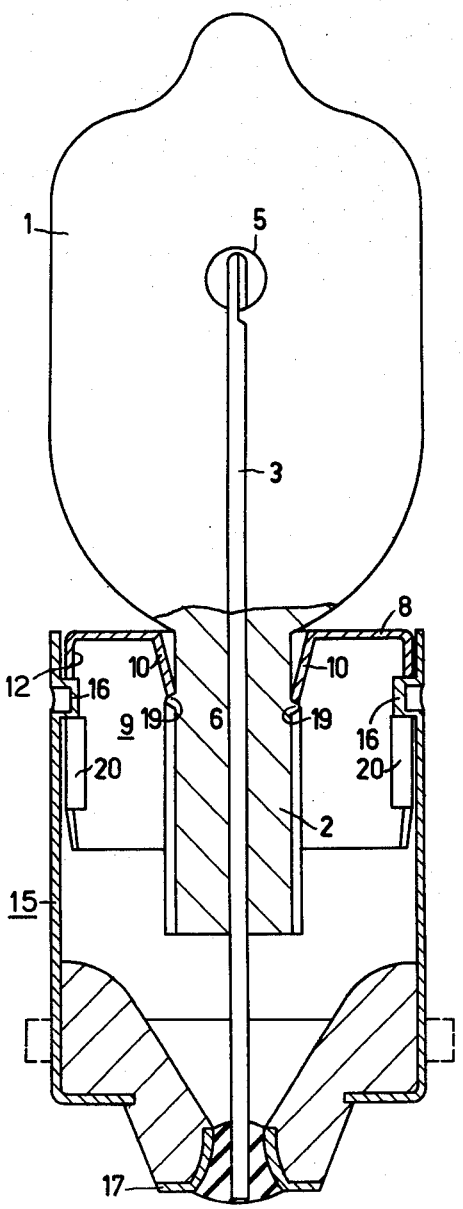
Figure 9:
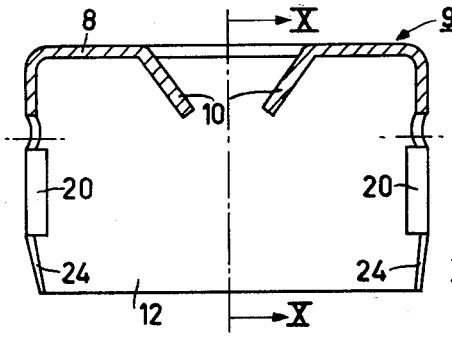
FIG. 9 shows a longitudinal section through the inner sleeve as in FIG. 8, along the line IX—IX.
Figure 10:
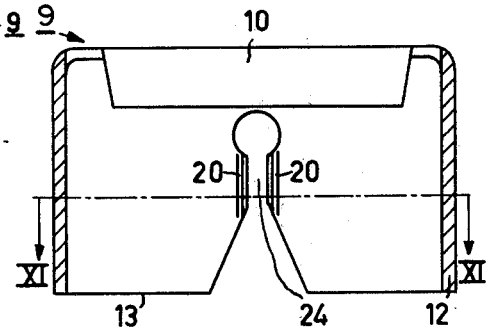
FIG. 10 shows a longitudinal section, turned through 90°, through the inner sleeve, along line X—X of FIG. 9.
Figure 8:
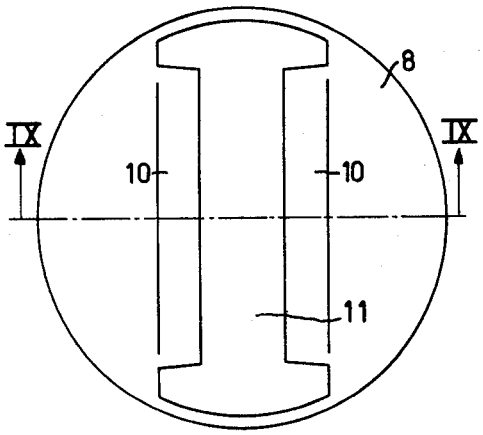
FIG. 8 shows a top view onto the inner sleeve of the lamp in FIGS. 6 and 7 on a larger scale.
Figure 11:
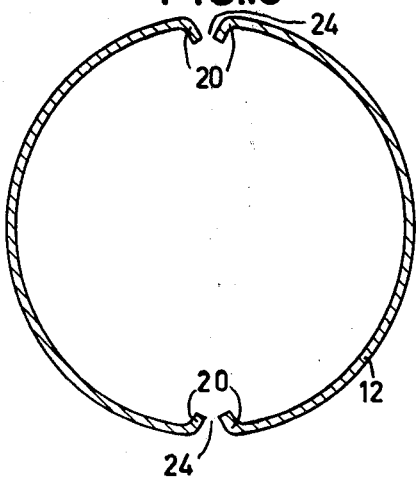
FIG. 11 shows a cross-section through the inner sleeve along line XI—XI of FIG. 10.

The inner sleeve 9 is again provided with slots 24, which open into the edge 13 of the cylindrical sheath 12 of the inner sleeve 9. However, the slots 24 in this case have spring clips 20 in their central part, which protrude inwards and consist of inwardly-bent edges of the cylindrical sheath 12 adjacent the slot. These spring clips 20 reduce the width of the slots 24 somewhat, but are pressed apart by the cap lugs 16 when the inner sleeve 9 is inserted into the sleeve-shaped cap 15, and in the final position of the inner sleeve 9 spring back behind the lugs 16, so that the inner sleeve 9 is axially secured in the cap 15. (FIG. 7).

What is claimed is:

1. An elongated electric lamp having an axis which comprises: a bulb, a sleeve-shaped cap, and a cylindrical inner sleeve carried in said sleeve-shaped cap, said cylindrical inner sleeve having first and second axial extremities and carrying said bulb at said first axial extremity, said sleeve-shaped cap having at least two lugs extending inwardly, said cylindrical inner sleeve having at least two slots extending in the direction of said lamp axis, said slots opening into said second axial extremity of said inner sleeve and engaging said lugs.

2. A lamp as claimed in claim 1, wherein said lugs are formed in the shape of protrusions pushed inwards from the metal wall of the cap.

3. A lamp as claimed in claim 1, or 2, wherein said slots are elongated and are wider at said axial extremity than elsewhere along the axial extent thereof.

4. A lamp as claimed in claim 1 or 2, wherein said slots have resilient edges which are pressed apart by said cap lugs during insertion of said cylindrical inner sleeve into said sleeve-shaped cap, and in the assembled position of said cylindrical inner sleeve are in compression behind said lugs.

5. A lamp as claimed in claim 4, in which said resilient edges which are bent inwardly.

6. A lamp as claimed in claim 4, wherein said slots are elongated and are wider at said second axial extremity than elsewhere along the axial extent thereof.

* * * * *